US005717378A

United States Patent [19]

Malvaso et al.

[11] Patent Number: 5,717,378

[45] Date of Patent: Feb. 10, 1998

[54] SECURITY SYSTEM WITH FALL BACK TO LOCAL CONTROL

[75] Inventors: John Anthony Malvaso, Victor; James Edward Berube, Farmington, both of N.Y.

[73] Assignee: Detection Systems, Inc., Fairport, N.Y.

[21] Appl. No.: 626,061

[22] Filed: Apr. 1, 1996

Related U.S. Application Data

[60] Provisional application No. 60/009,209, Dec. 22, 1995.

[51] Int. Cl.[6] ..... G08B 1/08

[52] U.S. Cl. ..... 340/506; 340/539; 340/502

[58] Field of Search ..... 340/506, 539, 340/531, 505, 502

[56] References Cited

U.S. PATENT DOCUMENTS

| | | | |
|---|---|---|---|
| 3,914,692 | 10/1975 | Seaborn, Jr. | 340/539 |
| 3,925,763 | 12/1975 | Wadhwani et al. | 340/539 |
| 4,427,974 | 1/1984 | Sheahan | 340/539 |
| 4,465,904 | 8/1984 | Gottsegen et al. | 340/518 |
| 4,611,198 | 9/1986 | Levinson et al. | 340/539 |
| 4,951,029 | 8/1990 | Severson | 340/506 |
| 5,327,478 | 7/1994 | Lebowitz | 379/39 |
| 5,365,217 | 11/1994 | Toner | 340/539 |
| 5,416,466 | 5/1995 | Malvaso et al. | 340/539 |
| 5,467,074 | 11/1995 | Pedtke | 340/539 |

*Primary Examiner*—Donnie L. Crosland
*Attorney, Agent, or Firm*—J. Addison Mathews

[57] ABSTRACT

A security system having a communications link with a central control, including a local network responds: a) to central control when the central communications link is operational; and, b) to local control when the central communications link malfunctions. More specifically, the local network includes a plurality of receivers for detecting emergency communications, an alarm for issuing a perceptible warning and a local control. The local control notifies the central control when an emergency signal is detected and activates the alarm in response to direction from the central control. The local control also includes logic for directly activating the alarm when an emergency signal is detected and there is no response from central control. According to more specific features, the central control includes data for validating emergency signals and activates the alarm only after validation. The local control, on the other hand, activates the alarm without validation.

6 Claims, 5 Drawing Sheets

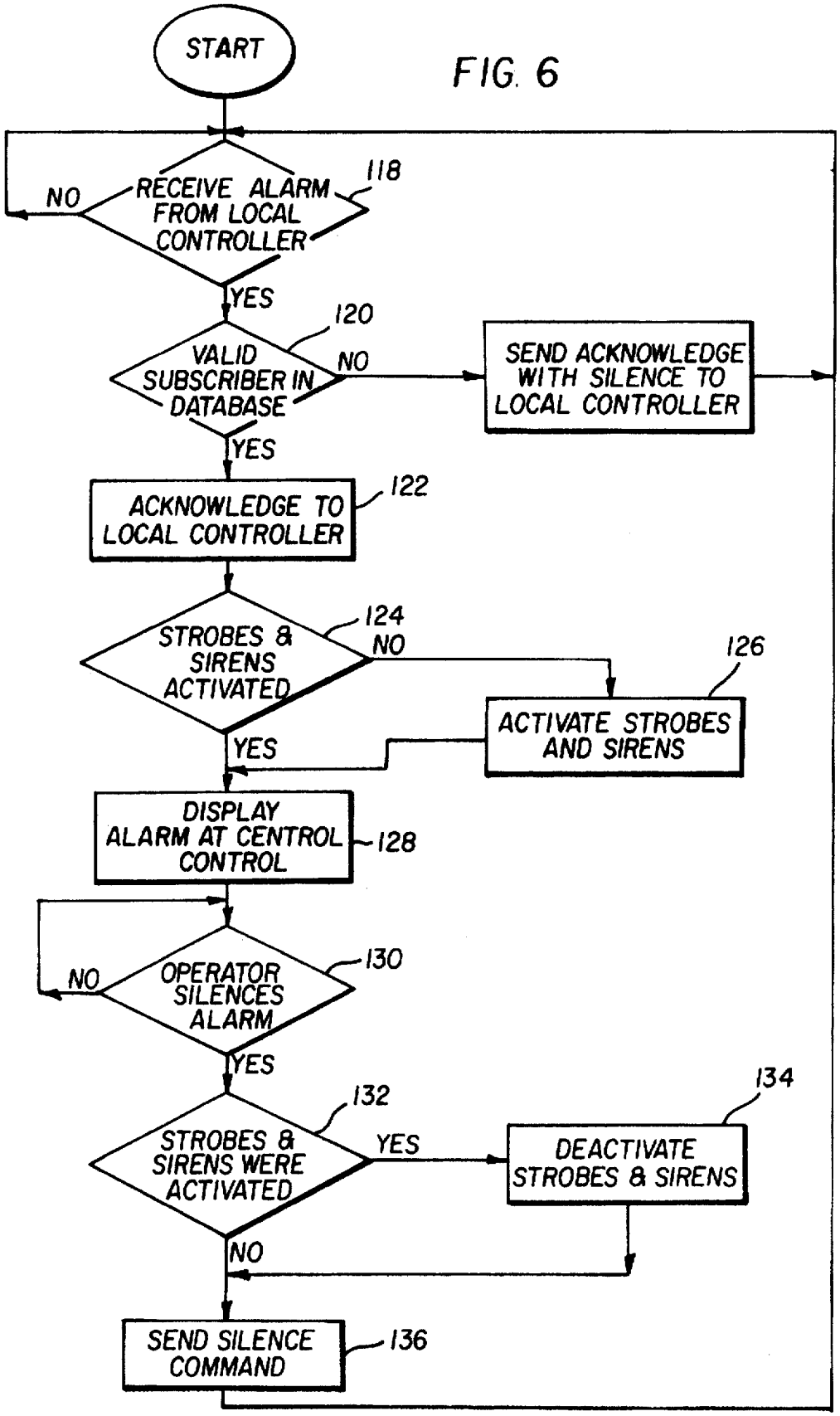
START
FIG. 6
RECEIVE ALARM FROM LOCAL CONTROLLER
118
NO
YES
VALID SUBSCRIBER IN DATABASE
120
NO
SEND ACKNOWLEDGE WITH SILENCE TO LOCAL CONTROLLER
YES
ACKNOWLEDGE TO LOCAL CONTROLLER
122
STROBES & SIRENS ACTIVATED
124
NO
126
ACTIVATE STROBES AND SIRENS
YES
DISPLAY ALARM AT CENTROL CONTROL
128
OPERATOR SILENCES ALARM
130
NO
YES
STROBES & SIRENS WERE ACTIVATED
132
YES
DEACTIVATE STROBES & SIRENS
134
NO
SEND SILENCE COMMAND
136

SECURITY SYSTEM WITH FALL BACK TO LOCAL CONTROL

CROSS REFERENCE TO RELATED APPLICATIONS

Reference is made to our corresponding provisional application Ser. No. 60/009209, filed Dec. 22, 1995.

DESCRIPTION

1. Field of Invention

The invention relates to security systems and more particularly to personal security systems including local receivers and alarms linked to a central control.

2. Background of the Invention

A number of recently proposed personal security systems include portable radio frequency transmitters carried by a system subscriber for actuation in an emergency or threatening situation. Fixed receivers monitor the area where the system is installed and initiate a planned sequence of events when an emergency transmission is detected. Sirens and strobes may be energized to scare away attackers while a call is made for assistance from appropriate security personnel. The system usually is monitored from a control station including a program for identifying the approximate location of the threatened subscriber. The locating program frequently uses triangulation techniques from the known positions of the receivers that detect the transmission. Examples are disclosed in Shields U.S. Pat. No. 4,998,095, issued Mar. 5, 1991; DeMarco U.S. Pat. No. 4,764,757, issued Aug. 16, 1988; and Levinson U.S. Pat. No. 4,611,198, issued Sep. 9, 1986. An improved approach for more precisely locating the transmission is disclosed in Kostusiak U.S Pat. No. 5,115,224. In addition to the known positions of the monitoring receivers, he uses the relative strengths of the received signals.

Testing is an important feature in security systems, and many alternatives are available. Reich et al. U.S. Pat. No. 4,908,602, issued Mar. 13, 1990, discloses a personal emergency response system, somewhat similar to those mentioned above, including a momentary action button on a fixed receiver for selectively placing the system in a test mode. Testing of the communications link between the portable transmitter and the receiver will not then initiate the alarm. Tamura et al. U.S. Pat. No. 4,694,282, issued Sep. 15, 1986, also discloses a test mode in a security system, this time actuated by a switch on a fixed transmitter. Tamura et al. transmit test signals to a receiver at a level representing a worst case environment. Still other examples are disclosed in Malvaso U.S. Pat. No. 5,416,466, issued Nov. 16, 1995, which includes fixed testing transmitters located adjacent the receivers, and Pedtke U.S. Pat. No. 5,467,074, issued Nov. 14, 1995, which discloses a two button transmitter that uses the same buttons actuated sequentially for an alarm and simultaneously for a test.

Although existing approaches include numerous alternatives for testing personal security systems, it will become apparent that further improvements are available in accordance with the present invention, particularly in a security system that takes appropriate alternative action when a failure occurs in some portion of the system.

SUMMARY OF THE INVENTION

The present invention is directed to improvements in security systems having a communications link with a central control. Briefly summarized, according to one aspect of the invention, a local network responds: a) to central control when the central communications link is operational; and, b) to local control when the central communications link malfunctions. More specifically, the local network includes a plurality of receivers for detecting emergency communications, an alarm for issuing a perceptible warning and a local control. The local control notifies the central control when an emergency signal is detected and activates the alarm in response to direction from the central control. The local control also includes logic for directly activating the alarm when an emergency signal is detected and there is no response from central control.

According to more specific features, the central control includes data for validating emergency signals and activates the alarm only after validation. The local control, on the other hand, activates the alarm without validation.

The invention not only detects malfunctions or failures in the central communications link, but also provides an alternative or back up course of action.

These and other features and advantages of the invention will be more clearly understood and appreciated from a review of the following detailed description of the preferred embodiments and appended claims, and by reference to the accompanying drawings.

BRIEF DESCRIPTION OF THE DRAWINGS

FIG. 6 is a flow diagram depicting operation of a central control of the personal security system of FIG. 1 in accordance with the preferred embodiment.

DETAILED DESCRIPTION OF THE INVENTION

Overview

Figure 1:
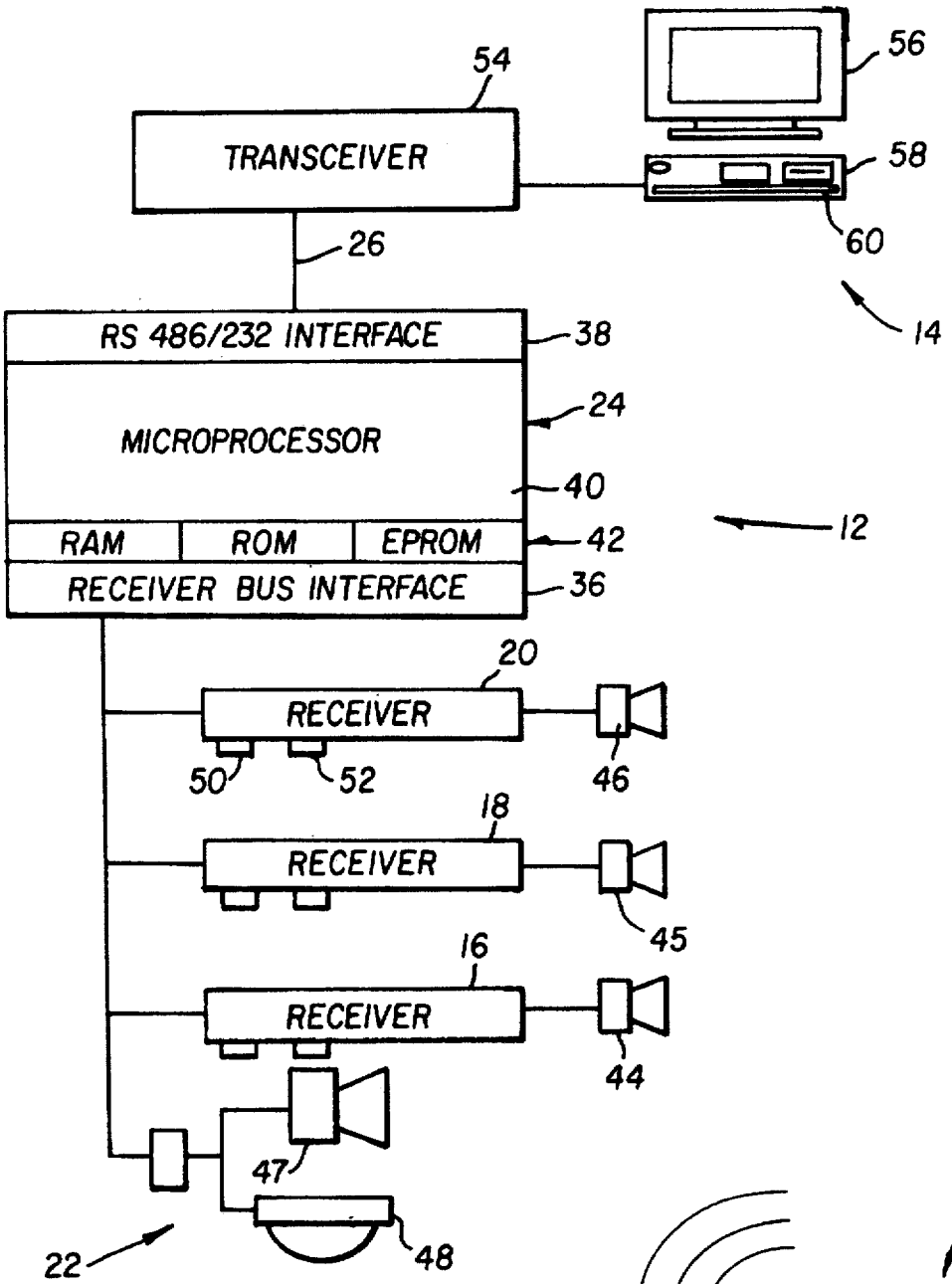
FIG. 1 is a block diagram representing a personal security system according to a preferred embodiment of the invention.
Figure 2:
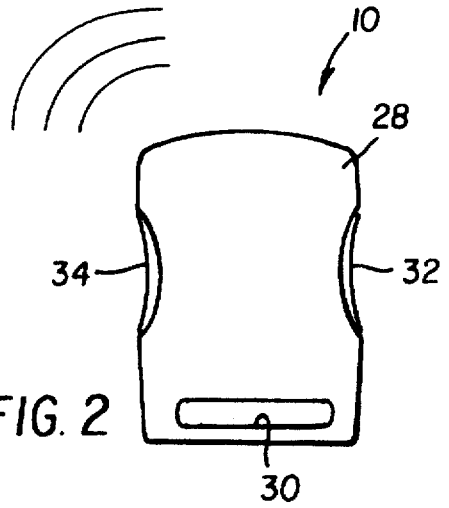
FIG. 2 is a portable wireless transmitter for use with the security system of FIG. 1.

Referring now to FIGS. 1 and 2, a preferred embodiment of the invention is depicted in a personal security system including wireless, hand-portable transmitters 10, one or more local receiving networks 12, and a central control 14.

The transmitters 10 are carried by subscribers to the system for actuation in emergency or threatening situations to scare away attackers and call for assistance. The transmitters send a radio frequency signal to the surrounding area, at a predetermined frequency and signal strength, including a unique code that identifies the transmitter.

The local networks 12 include a plurality of receivers 16, 18 and 20, alarms 22 and a local control 24 coupled through a communications link 26 to central control 14. The local networks monitor the protected area for emergency transmissions and, in combination with the central control 14, activate the alarms 22. The local networks 12 also detect information about the transmitted signal, including the strength of the received signal and the transmitter identification. This information is stored and forwarded to central control 14 for determining the location of the emergency transmission and the name of the subscriber to which the transmitter is assigned.

Central control 14 validates the transmission, by comparing the transmitter identification to a database of subscribers.

Assuming the transmission is from a current subscriber, alarms 22 are activated in the vicinity of the transmission, and security personnel are dispatched to the same area for assistance.

When communications link 26 malfunctions or communications otherwise fail with central control 14, one or more of the local networks take over in a fall back mode. The alarms 22 are then activated under the control of each respective local network 12 until proper communications are again established with central control 14.

Portable Transmitters

The hand-portable transmitters 10 are battery powered and adapted for convenient carrying in a purse or pocket. Each transmitter is enclosed in a plastic case 28 including a key ring 30 and two switches depicted as depressible buttons 32 and 34. The switches are designed for actuation from opposite sides of the case against a spring bias and in sequences that normally prevent accidental operation.

The switches 32 and 34 initiate transmissions including a code representing either an alarm or a test, depending on the manner in which the switches are actuated. Sequential actuation, first one switch and then the other, transmits a test code, while simultaneous actuation of the switches transmits an alarm code. In both cases, alarm or test, the transmitter produces and transmits a radio frequency signal to the local geographic area at a predetermined frequency and signal strength. The frequency may be in the three hundred or nine hundred megahertz range typical for such applications. The signal strength is chosen in combination with the number and locations of the fixed receivers, represented at 16, 18 and 20, so more than one and preferably at least three receivers typically will be able to identify and interpret the transmitted signal for the purposes to be described. At the same time, the signal strength, which falls off with the inverse square of the distance, should be weak enough to facilitate the location of the transmission based on differences in the signal strength at the detecting receivers.

The unique transmitter identification code is programmed and stored in transmitter memory, either at the time of manufacture or when the user subscribes to the system. The identification code is sent with the radio frequency signal including the alarm or test code. Further details of the transmitter and transmitted signal are disclosed in U.S. Pat. No. 5,467,074, issued Nov. 14, 1995, hereby incorporated by reference into the present specification.

Local Networks and Central Control

Although only one local network 12 is shown, a typical installation would include many similar networks located throughout the protected area, including buildings, open fields and parking lots. Similarly, each network would include more receivers and alarms than are depicted on the drawings.

In each network, the receivers 16, 18 and 20, and alarms 22, are multiplexed to local the controller 24. The controller 24 includes a receiver bus interface 36, a communications link interface 38, including a transponder or transmitter and receiver, and a microprocessor 40 with appropriate memory 42.

The receivers are tuned to continuously monitor the predetermined frequency used by the portable transmitters. They decode transmitter signals, validate the transmission for proper format, sample the strength of validated signals and set a normal/off-normal flag bit depending on the information received. A decoded transmission, assuming it is in the proper format, is stored in a data register in the receiver, including the received signal strength, the identification number of the portable transmitter and the state of the normal/off-normal flag bit.

The receivers communicate with their associated local controller 24 through the receiver bus interface 36. The local controller 24 queries each receiver. If the flag bit is normal, the controller continues with queries cycled to other receivers. If the flag bit is off-normal, indicating, for example, either an alarm or a test, the controller requests the stored information. This includes the reason for the off-normal condition, e.g. alarm or test, the strength of the received signal and the unique identification code of the sending transmitter. The local control 24 also associates the retrieved transmitter and signal information with a unique identification code representing the receiver that is holding the information.

Several receivers preferably will receive, store and transfer information resulting from a single alarm or test. The local controller 24 compares the information, selects the three strongest signals, and sends the information, including received signal strength, transmitter identification, and receiver identification, on to the central control 14. The central control makes a similar comparison with information that might be received from other networks and displays on a screen the location of the receivers of the three strongest signals.

When a received transmission represents an emergency, i.e. it includes the alarm code, each respective receiver of the signal activates a sounder 44, 45 and 46, such as a piezoelectric horn. The local controller forwards the alarm information to central control, and central control responds with an acknowledgment including commands to activate outside sirens 47 and strobes 48. The activated sirens and strobes are selected for their location proximate the three above-mentioned receivers detecting the highest signal strength. If the received transmission includes the code for a subscriber test, the information forwarded to central control, and the acknowledgment, are essentially the same as for an alarm, but the sounders are not energized and the returned commands do not activate the sirens or strobes. Instead, a green or red light emitting diode (LED) 50 or 52 is energized at the respective receivers. The green LED indicates a successful test by a valid subscriber. The red LED indicates a delinquent subscriber or otherwise unsuccessful test. In either case, an alarm or a test, the central control uses the unique identification of the portable transmitter to look in the database for a corresponding active subscriber, and uses the results to determine if the alarm or test should be validated.

Central control 24 includes a transceiver 54, monitor 56, and computer 58 including appropriate database memory. The central control communicates with the local controllers for activating the sirens 47 and strobes 48 in the alarm mode and the LEDs 50 and 52 in the test mode. The central control also is used for entering system information and parameters through a keyboard 60. The central control might include a map of the protected area and a program for showing the locations of receivers in the vicinity of an alarm or test transmission. Typically, the central control will store subscriber records including active or inactive status, identification of the portable transmitter assigned to each subscriber, and the times and locations from which it was used, either in an emergency or for a test.

Operation of Local Networks and Central Control

Figure 3:
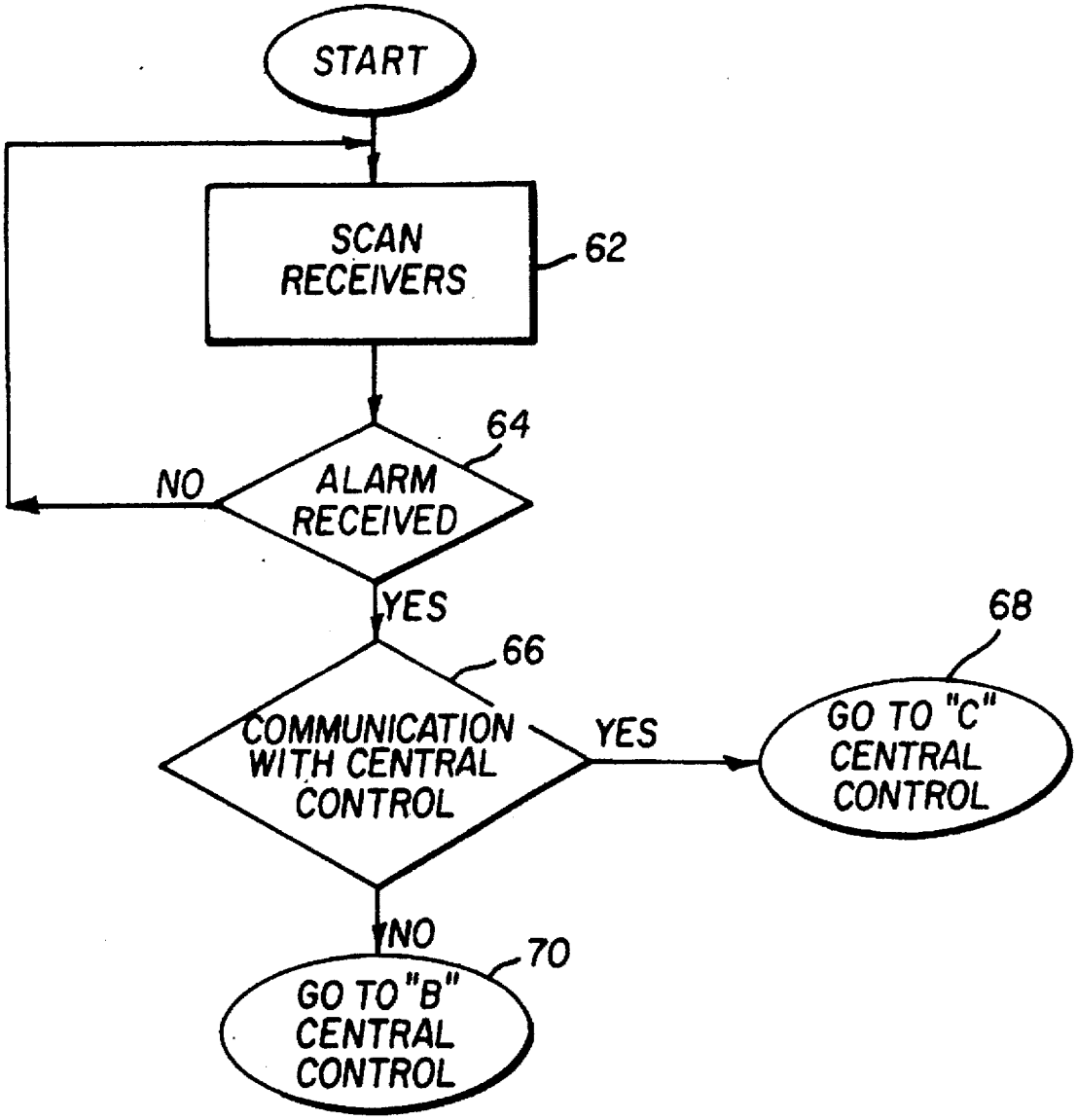
FIGS. 3–5 are flow diagrams depicting operation of a local control of the personal security system of FIG. 1 in accordance with the preferred embodiment.

Referring now to FIGS. 1 and 3, the operation of the local networks 12 and central control 14 is depicted in accordance with the preferred embodiment. Local controller 24 scans receivers 16, 18 and 20 for an off-normal flag indicating receipt of an alarm transmission, box 62. If an alarm transmission was received, box 64, the controller initiates communications between the local network 12 and central control 14. If the communications are successful, represented by an acknowledgment from central control, box 66, the local network responds to further commands from the central control, box 68. If no acknowledgment is received, box 66, the local controller takes over in a fall back mode, box 70.

Figure 4:
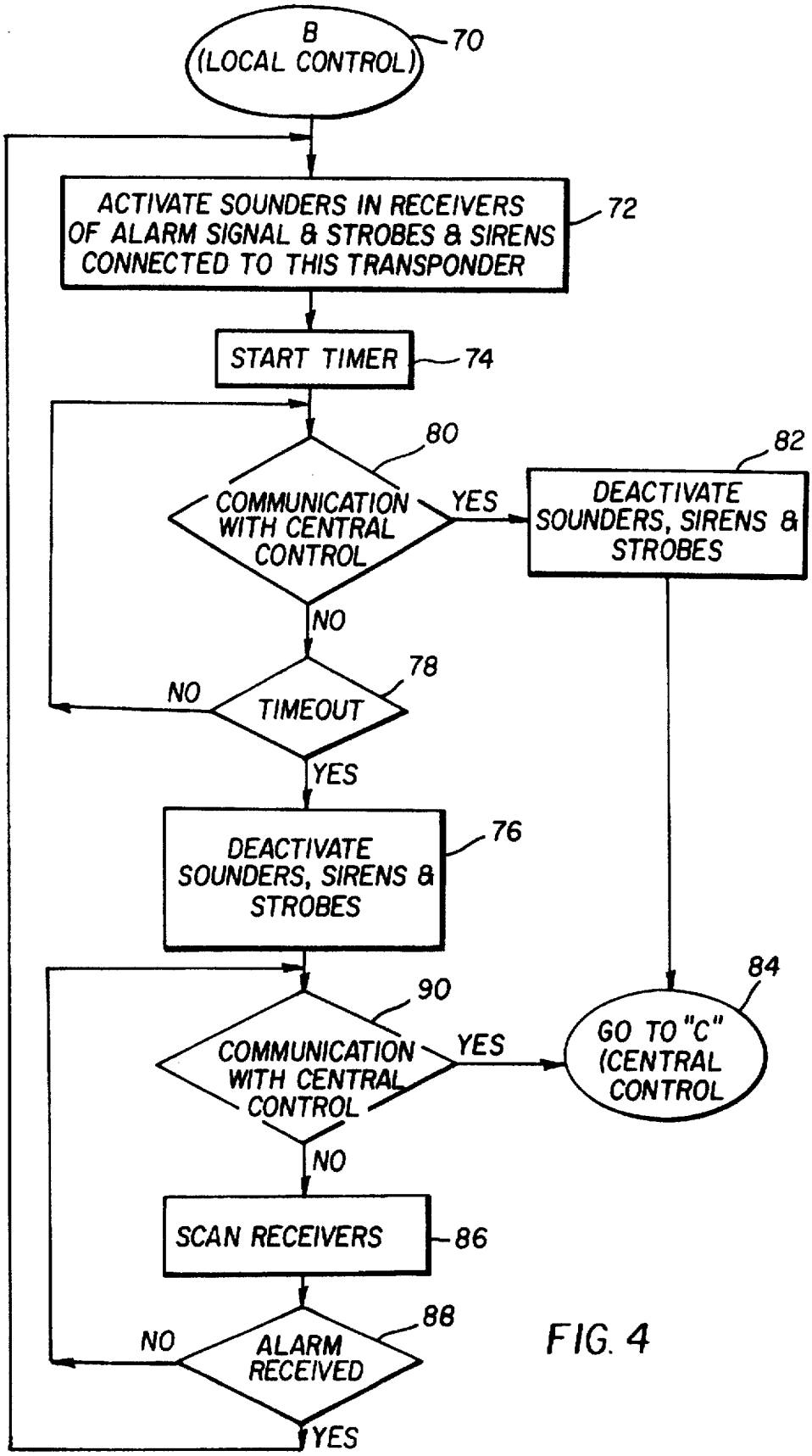

Operation in the fall back mode, or local control, is depicted on FIGS. 1 and 4. Sounders associated with the receivers of the alarm signal, 16 and 18, for example, are energized immediately, box 72. Outside sirens 47 and strobes 48 also are activated, box 72. These are the sirens and strobes associated with the local controller(s) of the receivers 16 and 18 that detected the alarm transmission. A timer is started, box 74, and the sounders, sirens and strobes continue to produce a perceptible alarm until deactivated, box 76, at the end of the time-out cycle, box 78. If communications are reestablished with central control during the time-out cycle, box 80, the local controller deactivates the sounders, sirens and strobes, box 82, and responds to further directions from central control, box 84. If communications with central control are not reestablished, the local controller continues to scan the receivers for an off normal flag, box 86, and respond to alarm transmissions, box 88, as described above. The local controller also continues attempts to reestablish communications with central control, box 90.

Figure 5:
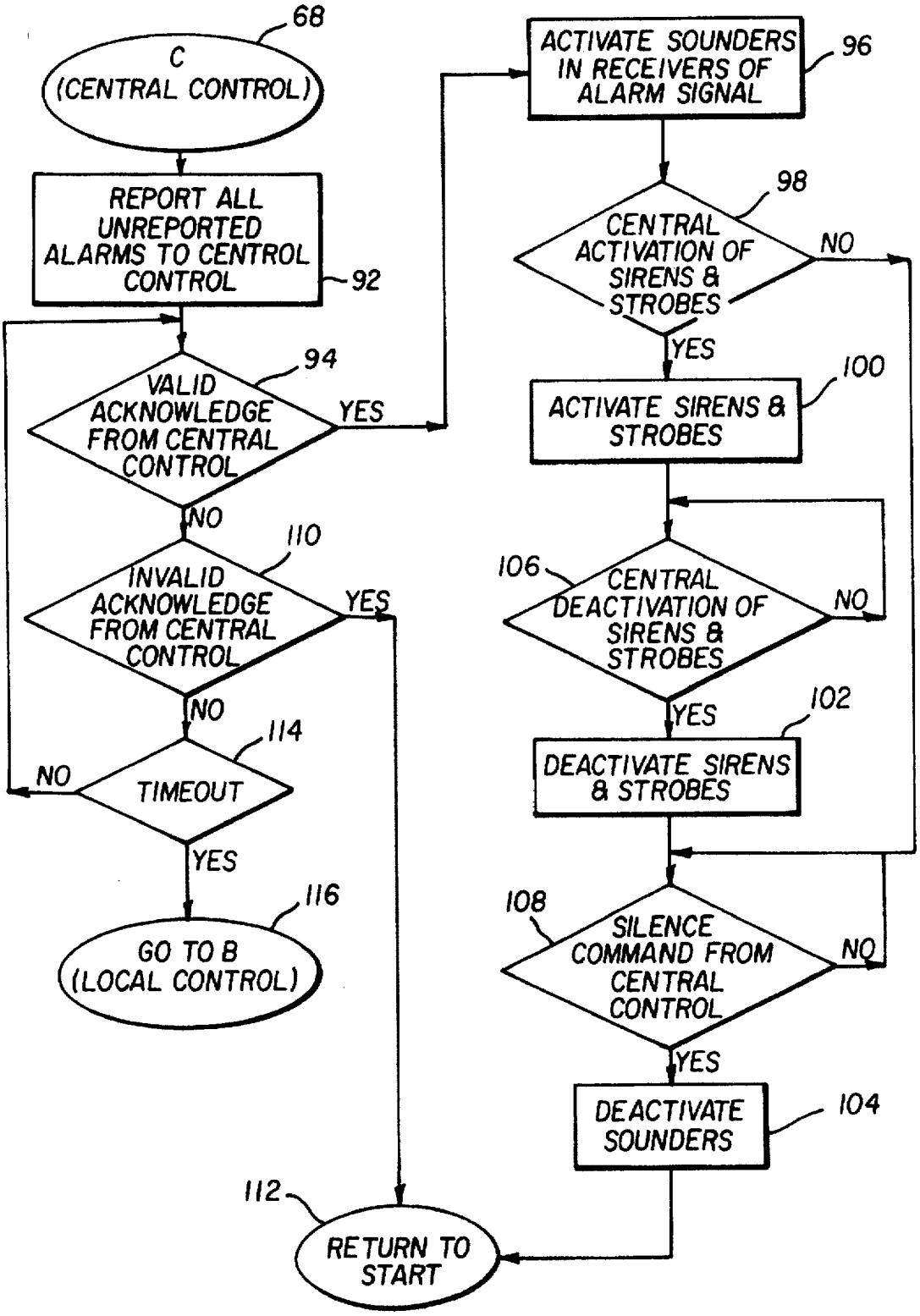

Operation in the normal, or central control mode, is depicted on FIGS. 1 and 5, for local network 12, and FIGS. 1 and 6, for the central control 14. All alarms that have not been previously reported are reported to central control, box 92. If a valid acknowledgment is received from central control, box 94, the sounders are energized at the receivers of the alarm transmission, box 96, and the outside sirens and strobes are activated in the vicinity of the transmission, boxes 98 and 100. The sounders, sirens and strobes continue until deactivation commands are received from central control, boxes 102 and 104. The sounders sirens and strobes are deactivated in responds to the central commands, boxes 106 and 108. If central control acknowledges the alarm report without a validation, box 110, no alarms are activated, box 112. An acknowledgment without a validation would occur, for example, if the transmitter identification does not correspond to a current and valid subscriber in the data base at central control. If there is no acknowledgment at all, box 114, control is returned to the local controller 24, box 116.

Referring to FIGS. 1 and 6, and central control 14, the data included with an alarm communication, box 118, is compared to the subscriber database, box 120. If valid, an acknowledgment is returned to the local controller with commands to activate the sirens and strobes, boxes 122, 124 and 126, and the location of the alarm is presented on the central display, box 128. The alarms continue until deactivation commands are initiated by an operator at central control, boxes 130, 132, 134 and 136.

It should now be apparent that a security system improved in accordance with the invention not only detects communication failures, but also provides for fall back operation until the failure is corrected. The local network and controller, which responds to central control when the communications link is operational, takes over when the communications link malfunctions and activates appropriate alarms without validation from central control.

While the invention is described in connection with a preferred embodiment, other modifications and applications will occur to those skilled in the art. The claims should be interpreted to fairly cover all such modifications and applications within the true spirit and scope of the invention.

We claim:

1. A security system including a local network, a remote central control and a bi-directional communications link between the local network and the central control, the network including a plurality of receivers for detecting an emergency signal from a protected area, an alarm for issuing a perceptible warning in the vicinity of the receivers and a driver for activating the alarm in response to the detection; characterized in that:

said local network automatically activates the alarm in response to said central control when said communications link is operational and in response to local network control when said communications link malfunctions.

2. The invention of claim 1, wherein said receivers are coupled to said communications link through a local control and said local control activates said alarm in response to said detection when said communication link malfunctions.

3. The invention of claim 2, wherein said central control includes data for validating emergency signals and activates said alarm only after validation, and wherein said local control activates said alarm absent said validation.

4. A personal security system comprising:

a plurality of portable wireless transmitters selectively actuatable to transmit emergency signals;

an alarm for issuing a perceptible warning in the vicinity of an actuated transmitter;

a central control including a database for validating said emergency signals;

a local network including a plurality of fixed receivers for detecting said emergency signals and a transponder for communicating between said receivers and said central control, said transponder notifying said central control upon detection of said emergency signals and said central control responding with an acknowledgment; and, local control logic in said local network, said local control logic automatically activating said alarm in response to said detected emergency signals in the absence of said acknowledgment.

5. The invention of claim 4, wherein each of said respective transmitters transmits an emergency signal including a unique identification code, said database includes a record of valid codes and said central control uses said valid codes to validate said signals.

6. The invention of claim 4, wherein said local control, upon detection of an emergency signal: a) responds to said central control in the presence of said acknowledgment and b) provides a back-up to activate said alarm in the absence of said acknowledgment.

* * * * *